US011353279B2

(12) United States Patent
Chia

(10) Patent No.: US 11,353,279 B2
(45) Date of Patent: Jun. 7, 2022

(54) TOY PROJECTILE LAUNCHER AND METHOD OF USING SAME

(71) Applicant: Easebon Services Limited, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 72 days.

(21) Appl. No.: 17/038,106

(22) Filed: Sep. 30, 2020

(65) Prior Publication Data

US 2021/0095935 A1 Apr. 1, 2021

Related U.S. Application Data

(60) Provisional application No. 62/908,789, filed on Oct. 1, 2019.

(51) Int. Cl.
*F41B 4/00* (2006.01)
*F41B 7/08* (2006.01)
(Continued)

(52) U.S. Cl.
CPC ..... *F41B 4/00* (2013.01); *F41B 7/006* (2013.01); *F42B 6/003* (2013.01); *F42B 6/08* (2013.01)

(58) Field of Classification Search
CPC ..... F41B 4/00; F41B 6/003; F41B 7/006; F41B 11/54; F41B 11/89; F41A 9/26; F41A 9/73; F41A 9/74
(Continued)

(56) References Cited

U.S. PATENT DOCUMENTS 2,962,017 A * 11/1960 Horowitz ..... F41B 7/006 124/27
4,986,251 A * 1/1991 Lilley ..... F41B 11/54 124/48
(Continued)

OTHER PUBLICATIONS

NERF, Nerf Doomlands The Judge, Amazon.com, https://www.amazon.com/Nerf-B8571-Doomlands-The-Judge/dp/B01MYEXN9T/ (accessed Feb. 12, 2018) (6 pp).
(Continued)

*Primary Examiner* — Alexander R Niconovich
(74) *Attorney, Agent, or Firm* — Amster, Rothstein & Ebenstein LLP

(57) ABSTRACT

A toy launcher for launching projectiles that includes a drum having a substantially circular shape and comprising a ring of projectile holders to hold projectiles for launching, the ring of projectile holders including a ring of inner support portions located substantially at a first radius from a center of the drum, each inner support portion adapted to support at least a portion of a projectile on an inner concentric ring of projectiles, and a ring of outer support portions located substantially at a second radius from the center of the drum, each outer support portion adapted to support at least a portion of a projectile on an outer concentric ring of projectiles, wherein the second radius is different than the first radius, and wherein the drum includes a ring of front openings and a ring of rear openings that are aligned with at least the inner concentric ring of projectiles.

19 Claims, 14 Drawing Sheets

(51) Int. Cl.

| | |
|---|---|
| ***F41B 11/54*** | (2013.01) |
| ***F42B 6/00*** | (2006.01) |
| ***F41B 7/00*** | (2006.01) |
| *F42B 6/08* | (2006.01) |

(58) Field of Classification Search
USPC ..... 124/45, 48, 78
See application file for complete search history.

(56) References Cited

U.S. PATENT DOCUMENTS

| | | | | |
|---|---|---|---|---|
| 5,150,701 | A * | 9/1992 | Wackrow | F41B 11/57 124/67 |
| 5,522,374 | A * | 6/1996 | Clayton | F41B 11/54 124/48 |
| 5,709,199 | A * | 1/1998 | Johnson | F41B 11/54 124/48 |
| 5,724,955 | A * | 3/1998 | Johnson | F41B 11/54 124/72 |
| 5,988,152 | A * | 11/1999 | Halter | F41B 11/54 124/31 |
| 6,076,511 | A * | 6/2000 | Grimm | F41B 7/003 124/16 |
| 6,439,216 | B1 * | 8/2002 | Johnson | F41B 9/0018 124/70 |
| 8,127,754 | B1 * | 3/2012 | Johnson | F41B 11/646 124/66 |
| 8,186,337 | B2 * | 5/2012 | Nadel | F41B 11/89 124/63 |
| 8,353,277 | B2 * | 1/2013 | Huebl | F41B 11/89 124/78 |
| 8,402,958 | B2 | 3/2013 | Victor et al. | |
| 8,695,579 | B2 | 4/2014 | Huebl | |
| 8,875,690 | B2 * | 11/2014 | Chor-Ming | F41B 11/54 124/82 |
| 9,027,541 | B2 * | 5/2015 | Huebl | F41B 11/681 124/56 |
| 9,097,476 | B2 * | 8/2015 | Mead | F41A 9/63 |
| 9,341,422 | B2 * | 5/2016 | Rodich | F41B 5/00 |
| 9,513,075 | B2 * | 12/2016 | Lallier | F41A 9/73 |
| 9,726,446 | B2 | 8/2017 | Wong et al. | |
| 9,958,230 | B1 * | 5/2018 | Nugent | F41A 9/73 |
| 10,648,765 | B2 * | 5/2020 | Miller | F41B 7/006 |
| 10,859,337 | B1 * | 12/2020 | Bernal | F41B 7/08 |
| 10,935,340 | B1 * | 3/2021 | Joukov | F41B 7/08 |
| 11,098,976 | B2 * | 8/2021 | Call | F41B 11/54 |
| 11,226,168 | B2 * | 1/2022 | Kowalczyk, Jr. | F41B 11/54 |
| 2002/0166551 | A1 * | 11/2002 | Lee | F41B 4/00 124/78 |
| 2009/0095272 | A1 * | 4/2009 | Zimmerman | F41B 4/00 124/78 |
| 2009/0314272 | A1 * | 12/2009 | Lin | F41A 9/74 124/48 |
| 2011/0041823 | A1 * | 2/2011 | Victor | F41B 4/00 124/48 |
| 2019/0383575 | A1 | 12/2019 | Chia | |
| 2020/0309482 | A1 * | 10/2020 | Bernal | F41B 11/723 |

OTHER PUBLICATIONS

MEGE, Nerf N-Strike MEGA Mastodon Blaster with 24 dart drum and 72 MEGA Whistler Darts 100 ft Shooting Distance by Mege, Amazon.com, https://www.amazon.com/N-Strike-Mastodon-Whistler-Shooting-Mege/dp/B01M8KGXDO (accessed Feb. 12, 2018) (6 pp).

Dart Zone Covert Ops, Dart Zone Magnum Superdrum Blaster, primetimetoys.com, https://www.primetimetoys.com/toys/dart-zone-magnum-superdrum-blaster/ (accessed Jun. 22, 2018) (2 pp).

Dartstorm Motorized Belt Blaster (2018) Dart Zone & Prime Time Toys, https://dartzoneblasters.com/shop/dart-zone-covert-ops/dartstorm-belt-blaster/ (accessed Feb. 12, 2018) (2 pp).

Buzz Bee Toys Automatic Tommy 20 Dart Blaster, Kmart.com, https://www.kmart.com/buzz-bee-toys-automatic-tommy-20-dart-blaster/p-004W548123110001P (accessed Jun. 22, 2018) (4 pp).

Buzz Bee Sidewinder Box, Blasterhub.com, https://www.blasterhub.com/buzz-bee-sidewinder-box/ (accessed Jun. 22, 2018) (3 pp).

X-Shot Turbo Advance Xcess Dart Blaster Shooter Playset—w/ Blaster, Darts and Accessories—100 Pieces, Amazon.com, (accessed Jun. 22, 2018) https://www.amazon.com/X-Shot-Advance-Blaster-Shooter-Playset/dp/B077BG25FL/ref=sr_1_1?ie=UTF8&qid=1529698109&sr=8-1&keywords=zuru+xshot+turbo+advance (6 pp).

Mattel—BOOMco Breakflip Blaster, amazon.com, https://www.amazon.eom/BOOMCo-Breakflip-Exclusive-Metallic-Blaster/dp/B018G2405U/ (accessed Jun. 28, 2018) (8 pp).

X-Shot Turbo Advance Dart Blaster from Zuru, ttpm.com (accessed Jun. 27, 2018) https://ttpm.com/p/24073/zuru/x-shot-turbo-advance-dart-blaster/ (1 page).

Review: Buzz Bee Double Drum (15m) | Blaster Hub (accessed Jun. 28, 2018) https://www.blasterhub.com/2017/09/review-buzz-bee-double-drum-15m/ (10 pp).

Adventure Force Af Decimator Dart Blaster—Walmart.com (accessed Jun. 28, 2018) https://www.walmart.com/ip/Adventure-Force-Af-Decimator-Dart-Blaster/209973333 (4 pp).

* cited by examiner

TOY PROJECTILE LAUNCHER AND METHOD OF USING SAME

CROSS-REFERENCE TO RELATED APPLICATION

This application claims the benefit of and priority to U.S. Provisional Patent Application No. 62/908,789, filed Oct. 1, 2019, the entire contents of which are incorporated herein by reference.

FIELD

The present invention is generally related to a toy projectile launcher, such as a toy dart launcher, with a high capacity magazine.

BACKGROUND

Toy launchers that discharge soft projectiles, such as toy foam darts or toy foam balls—commonly referred to as toy "guns" or "shooters"—are well known in the art. The toy projectiles are designed to safely impact upon a target without causing injury or damage.

Toy launchers may use one of various different mechanisms for launching the projectiles. One common mechanism for launching toy projectiles from a toy launcher involves the application of compressed air on the projectiles to launch them. The compressed air must be carefully controlled so as to only be in fluid contact with the projectile or projectiles that are intended to be launched at a particular time. Another known mechanism to launch toy projectiles is to feed the toy projectiles to contact one or more rotating flywheels and thereby propel the projectiles forward toward a target.

Prior art launchers use one of a variety of different types of magazines for toy darts. For example, one type of magazine has a clip or cartridge for feeding darts to a barrel of the launcher. Another type of magazine holds the darts and advances the darts to firing position with a biasing spring when released upon activation of a trigger.

As another example, a straight magazine may hold darts in one or more rows of dart holders, with a possible offset between the rows. A straight magazine may, for example, be input horizontally into a compatible toy launcher and passes sideways through the launcher as darts are launched. Such a magazine has been used with a compatible compressed air toy launcher, but is not ideal as a magazine that moves sideways requires a clearance on either side of the launcher and must be reinserted each time that it is reloaded.

Another known type of magazine is a circular drum-style magazine.

One such prior art launcher, for example, includes a drum that has a single ring of toy dart holders arrayed around the drum. This launcher launches the darts with motorized flywheels positioned in front of the drum and darts are pushed one at a time from the drum to the flywheels for launch. A shortcoming of this launcher is that the number of darts that can fit in a single ring on a drum is limited in practice by the size of the launcher.

A different prior art launcher includes a drum having two concentric rings of darts where the concentric rings are aligned with one another and the toy darts are launched sequentially first from one ring and, after all of the darts in one ring are launched, then the darts in the other ring are launched. This launcher requires a switch between launching from one ring to another after one ring is fully depleted of darts and is inefficient as it requires two rotations of the drum to launch all of the darts.

To address the above, an improved toy launcher and a drum to be used therewith was developed and resulted in an invention by Applicant described in pending U.S. patent application Ser. No. 16/007,660, filed Jun. 13, 2018, now U.S. Pat. No. 10,533,821.

SUMMARY

The present invention is generally related to an improved toy launcher for launching projectiles, such as soft projectiles like toy darts or toy balls. Particularly, to improve upon the toy launcher disclosed in U.S. patent application Ser. No. 16/007,660 (U.S. Pat. No. 10,533,821) with a more simplified construction, an improved drum and operating mechanism is described herein that would necessitate only one pushing rod mechanism while still providing for multiple concentric rings of darts to be stored in the drum. The simplified construction of the present invention significantly reduces the material costs of the launcher.

In accordance with an embodiment of the present invention, a toy launcher for launching projectiles includes a drum having a substantially circular shape and a ring of projectile holders to hold two or more concentric rings of projectiles for launching. The drum includes a first of the two or more concentric rings located substantially at a first radius from the center of the drum and a second of the two or more concentric rings located substantially at a second radius from the center of the drum, wherein the second radius is different than the first radius. Adjacent projectile holders are separated from one another by a respective divider, and respective projectiles in the first concentric ring are aligned with the respective projectiles in the second concentric ring. The toy launcher further includes one or more flywheels positioned in front of a first side of the drum that are adapted to propel at least one of the projectiles when pushed from the drum toward the one or more flywheels for launching the at least one of the projectiles out of the toy launcher.

In embodiments, the toy launcher further includes a projectile advancement assembly to push the projectiles from the projectile holders of the drum one at a time toward the one or more flywheels to launch the projectiles. The projectile advancement assembly includes a pushing rod that is positioned so as to be aligned with the projectile holders in the first concentric ring and adapted to push at least one of the projectiles from the projectile holders of the first concentric ring.

In embodiments, the toy launcher further includes a trigger that, upon activation, causes an incremental rotation of the drum and engages the projectile advancement assembly to push the pushing rod forward toward the drum such that the pushing rod that is in alignment with a respective one of the projectile holders in the first concentric ring is adapted to mechanically push a first of the projectiles, when loaded, in the respective one of the projectile holders to engage with at least one of the one or more flywheels to launch the first projectile.

In embodiments, the pushing rod is spring-loaded.

In embodiments, the drum includes a second side with a plurality of openings to the projectile holders corresponding to each of the plurality of projectile holders in the first concentric ring. The plurality of openings are sized to allow the pushing rod to fit through each of the plurality of openings in the first concentric ring.

In embodiments, the drum further includes, on the second side of the drum, a plurality of non-linear grooves with each groove corresponding to a different one of the plurality of projectile holders in the first concentric ring. The toy launcher further includes a pawl that is adapted to glide through each of the plurality of non-linear grooves to rotate the drum incrementally upon gliding through one of the plurality of non-linear grooves.

In embodiments, the projectile advancement assembly further includes a spring-loaded push member mounted on the launcher that exerts a force on a dart in the second concentric ring to push the dart in the second concentric ring towards the first concentric ring.

In embodiments, the spring-loaded push member exerts sufficient force to push a dart on the second concentric ring into a corresponding position in the projectile holder on the first concentric ring in the drum when the corresponding position in the projectile holder on the first concentric ring is empty.

In embodiments, the drum further includes a plurality of support structures that separate the darts in the second concentric ring from the darts in the first concentric ring.

In embodiments, the projectiles are toy darts.

In embodiments, the projectiles are toy balls.

In embodiments, the drum is removable from the toy launcher. In embodiments, the drum is non-removable from the toy launcher.

In embodiments, at least one of the one or more flywheels are motorized and are positioned adjacent the drum so as to engage with the respective projectile when the respective projectile is pushed out of the drum.

In embodiments, the one or more flywheels include at least one elongated flywheel that extends in length adjacent the first concentric ring of projectile holders.

In embodiments, the projectile holders are substantially equally spaced apart from one another.

In embodiments, the plurality of projectile holders are adapted to hold toy darts.

In embodiments, the projectile holders are of substantially equal dimensions.

In accordance with an embodiment of the present invention, a toy launcher for launching projectiles includes a drum having a substantially circular shape and a ring of projectile holders to hold projectiles in two or more concentric rings for launching. The drum includes a first of the two or more concentric rings located substantially at a first radius from the center of the drum and a second of the two or more concentric rings located substantially at a second radius from the center of the drum, wherein the second radius is different than the first radius. Adjacent projectile holders are each separated from one another by a respective divider.

The toy launcher further includes a projectile advancement assembly to push the projectiles from the projectile holders of the drum one at a time to launch the projectiles. The projectile advancement assembly has a pushing rod that is positioned so as to be aligned with the projectile holders in the first concentric ring and adapted to push at least one of the projectiles from the projectile holders of the first concentric ring.

The toy launcher also includes a trigger that, upon activation, causes an incremental rotation of the drum and engages the projectile advancement assembly to push the pushing rod forward substantially simultaneously toward the drum such that the pushing rod that is in alignment with a respective one of the projectile holders in the first concentric ring is adapted to mechanically push a first of the projectiles, when loaded, in the respective one of the projectile holders to launch the first projectile.

In embodiments, the pushing rod is spring-loaded.

In embodiments, the respective projectile holders hold the darts in the first and second concentric rings that are angularly aligned with each other.

According to an exemplary embodiment of the invention, a toy launcher for launching projectiles includes a drum having a substantially circular shape and comprising a ring of projectile holders to hold projectiles for launching, the ring of projectile holders including a ring of inner support portions located substantially at a first radius from a center of the drum, each inner support portion adapted to support at least a portion of a projectile on an inner concentric ring of projectiles, and a ring of outer support portions located substantially at a second radius from the center of the drum, each outer support portion adapted to support at least a portion of a projectile on an outer concentric ring of projectiles, wherein the second radius is different than the first radius, wherein the drum includes a ring of front openings and a ring of rear openings that are aligned with at least the inner concentric ring of projectiles; a push rod adapted to extend through one of the rear openings and push a corresponding one of the inner concentric ring of projectiles through a corresponding one of the front openings; and a trigger that, upon activation, engages the push rod to extend through the one rear opening and push the corresponding one projectile through the corresponding one front opening.

In embodiments, the toy launcher includes a drum advancement mechanism that causes an incremental rotation of the drum.

In embodiments, the drum advancement mechanism is one of an automated mechanism and a manual mechanism coupled to a cocking handle.

In embodiments, the toy launcher includes a push member adapted to exert a pushing force on one of the outer concentric ring of projectiles towards the ring of inner support portions.

In embodiments, the push member is spring loaded and includes a push surface and a release surface.

In embodiments, the push surface abuts the one of the outer concentric ring of projectiles when the drum advancement mechanism causes the incremental rotation of the drum.

In embodiments, the inner support portions are angularly aligned with the outer support portions so that, when the drum is fully loaded, each of the inner concentric ring of projectiles is angularly aligned with a corresponding one of the outer concentric ring of projectiles.

In embodiments, each front opening includes at least a first dimension smaller than a radius of the projectiles and at least a second dimension larger than the radius of the projectiles.

In embodiments, the front openings are tilted so that an outer portion of each front opening is tilted toward a direction of rotation of the drum.

In embodiments, the inner support portions are angularly aligned with the outer support portions so that a projectile is movable slidingly from the outer concentric ring to the inner concentric ring.

According to an exemplary embodiment of the invention, a drum for holding projectiles adapted for launch in a toy launcher includes a ring of inner support portions located substantially at a first radius from a center of the drum, each inner support portion adapted to support at least a portion of a projectile on an inner concentric ring of projectiles; a ring of outer support portions located substantially at a second radius from the center of the drum, each outer support portion adapted to support at least a portion of a projectile on an outer concentric ring of projectiles, wherein the second radius is different than the first radius, a ring of rear openings that are aligned with at least the inner concentric ring of projectiles; and a ring of front openings, each front opening having at least one dimension smaller than a radius of the projectiles and at least another dimension larger than the radius.

In embodiments, the front openings are tilted so that an outer portion of each front opening is tilted toward a direction of rotation of the drum when the drum is coupled to the toy launcher.

BRIEF DESCRIPTION OF THE DRAWINGS

Exemplary embodiments of the present invention will be described with references to the accompanying figures, wherein.

DETAILED DESCRIPTION

The present invention is generally related to an improved toy launcher with a drum for launching projectiles. To achieve a high capacity, the drum includes a ring of projectile holders that can accommodate at least two concentric rings of projectiles. In embodiments, the projectile holders are adapted to hold one or more types of projectiles, such as toy foam darts, foam balls, or other objects. A pushing rod for one or more of the at least two concentric rings of projectiles are simultaneously activated and advance toward a back of the drum to push the projectiles, one at a time, from the front of the drum toward one or more flywheels that propel each projectile out of the launcher and toward a target. In embodiments, the pushing rod(s) is(are) spring-loaded or gear-driven, and the one or more flywheels may be motorized. The projectiles are launched in a sequence that empties a first concentric ring of projectiles before launching projectiles from a second concentric ring.

Figure 1:
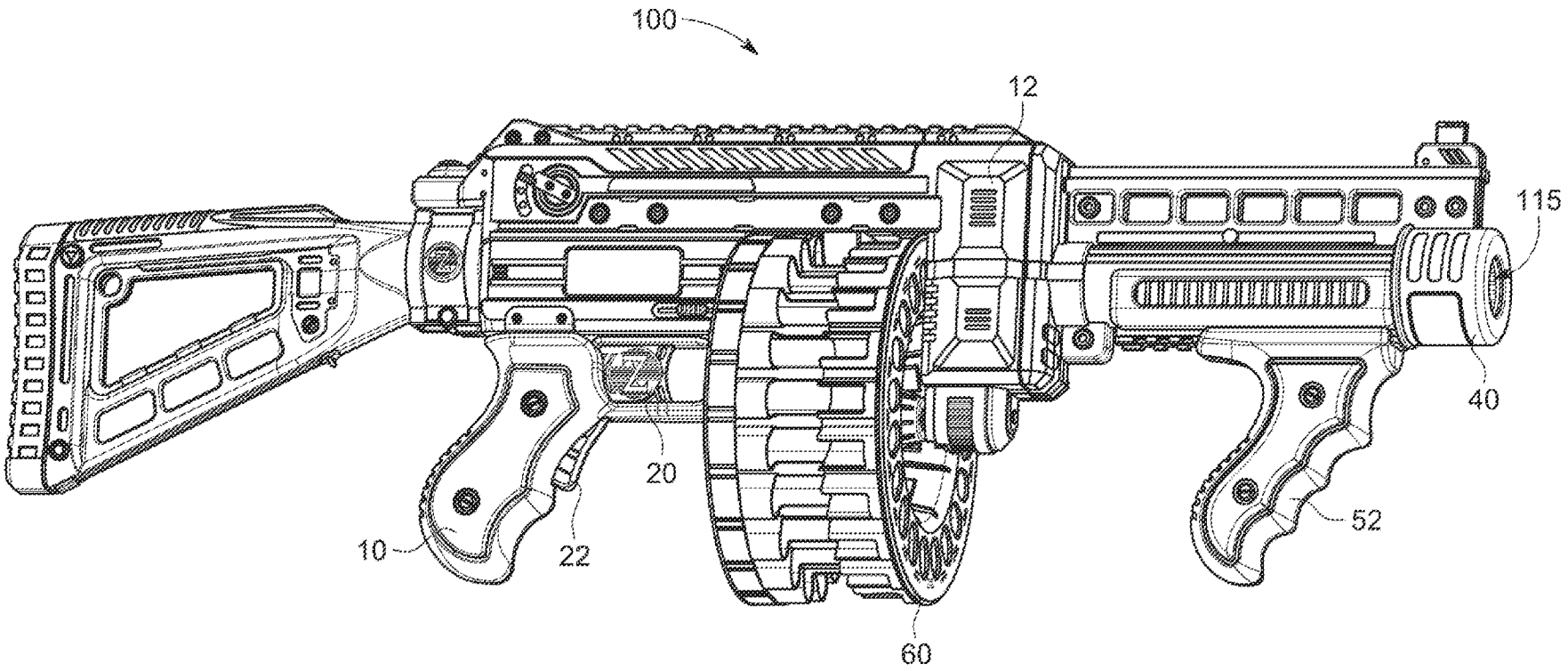
FIG. 1 is a first perspective view of a toy dart launcher with a drum for holding the toy darts inserted in accordance with an embodiment of the present invention.
Figure 2:
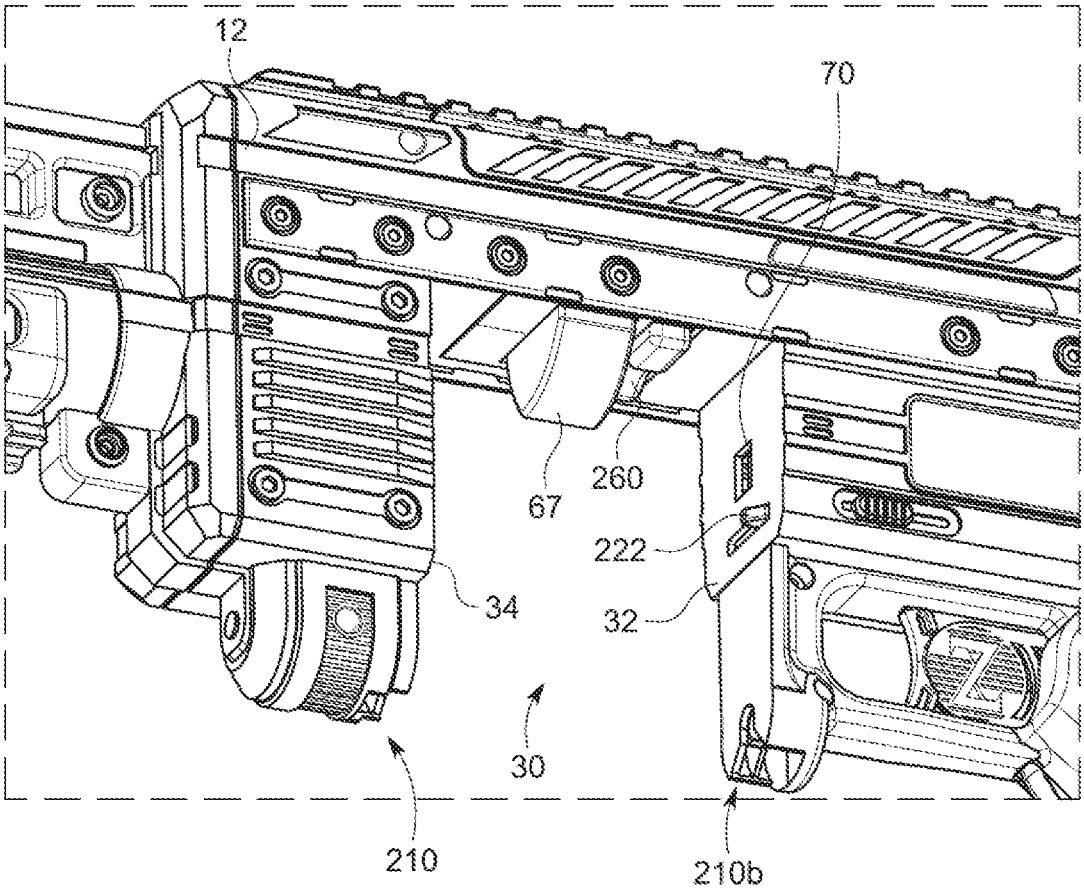
FIG. 2 is a second perspective view of the toy dart launcher shown in FIG. 1, without the dart holding drum, from a different angle, in accordance with an embodiment of the present invention.

Referring to FIGS. 1 and 2, a launcher 100 for projectiles in accordance with an exemplary embodiment of the present invention includes a handle 10 for holding the back end of launcher 100, a front handle 52 for holding the front of launcher 100, a trigger 20 for launching projectiles, a designated space or recess 30, shown in FIG. 2, for accepting a magazine such as a substantially circular drum 60 (see FIG. 1) into which toy darts or other objects are to be loaded, and a barrel 40 at the front of launcher 100 out of which the darts are propelled. Barrel 40 extends between an opening (not shown) in front wall 34 and a front opening 115 of launcher 100. Launcher 100 further includes a projectile advancement assembly having a pushing rod 70, and launcher 100 also includes flywheels (not shown) within an outer shell 12 between the opening in front wall 34 and front opening 115, a power supply, such as battery compartment (not shown) into which batteries may be placed to power launcher 100, and an on/off switch 22 to turn on and off the flywheels. Recess 30 is located between a back wall 32 and a front wall 34.

As shown in FIG. 2, launcher 100 includes opening 210 on a bottom portion of front wall 34 of recess 30 for receiving an attachment element 120 (such as a knob and the like) of drum 60, as will be described in further detail below with reference to FIG. 3. Correspondingly, a similar opening 210*b* is incorporated on a bottom portion of back wall 32 of recess 30 for receiving a corresponding knob (not shown) on a back portion of drum 60. FIG. 2 further illustrates a spring-loaded push member 67 and a notched stopper 260 (described in further detail below) integrated to a top portion of recess 30 of launcher 100. Additionally, a drum advancement pusher (hook element) 222 and a push rod 70 are incorporated to the back wall 32 in recess 30, which will be described in further detail below with reference to FIGS. 5A and 5B.

Figure 3:
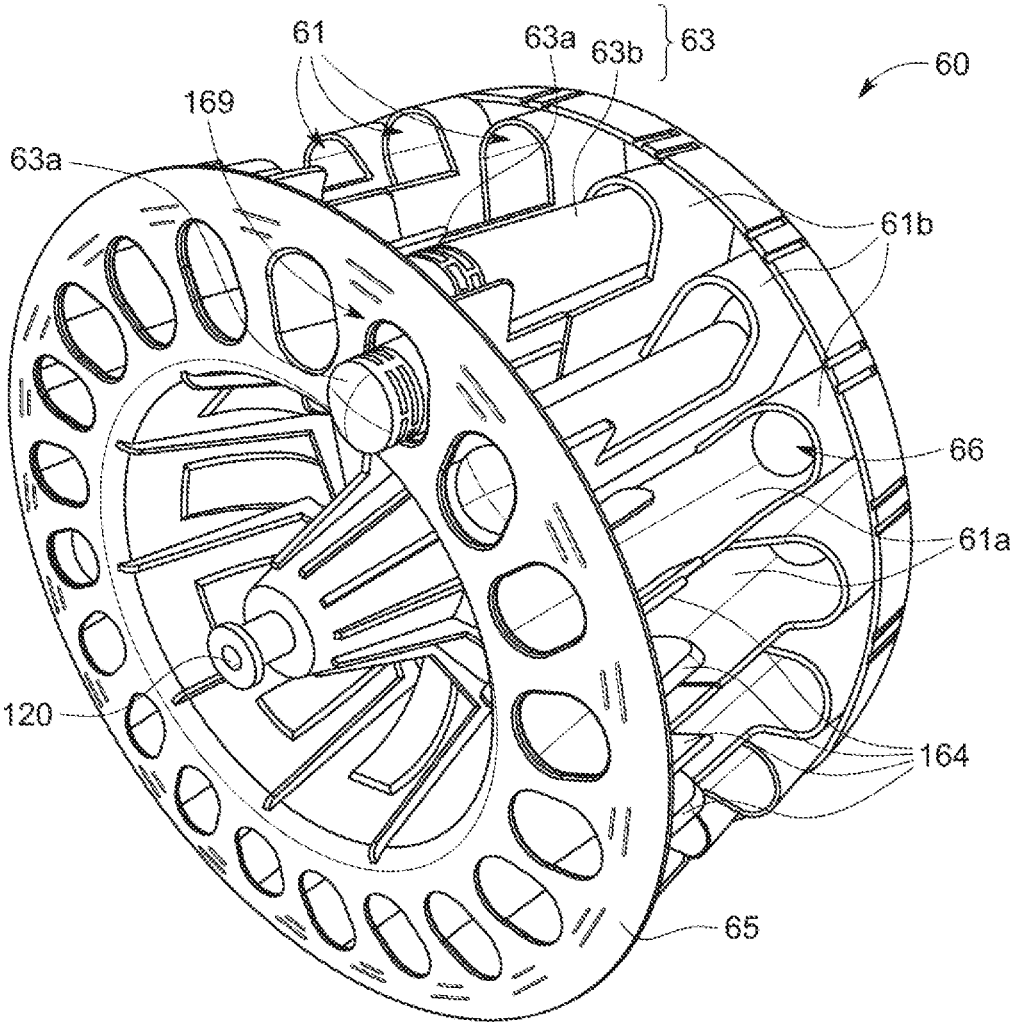
FIG. 3 is a perspective view of the drum shown in FIG. 1 according to an exemplary embodiment of the present invention.

FIG. 3 is a perspective view of drum 60 according to an exemplary embodiment of the present invention. As shown in FIG. 3, drum 60 may include twenty (20) integrated dart holders 61 with aligned partial enclosures for holding two aligned concentric rows of darts 63—in other words, affording storage of forty (40) darts 63 in drum 60. As shown in FIG. 3, drum 60 includes an inner ring of support portions 61*a* and an outer ring of support portions 61*b* to form each of the dart holders 61. Correspondingly, drum 60 further includes enclosure flaps 164 for holding in the outer ring of darts 63 around their front dart caps 63*a* by partially reaching around both sides over each dart 63 on the outer ring, as illustrated in FIG. 3. FIG. 3 further illustrates an attachment element 120, which may be a rotatable knob or the like, for detachably engaging a corresponding rotatable attachment mechanism, including opening 210 illustrated in FIG. 2. Additionally, FIG. 3 illustrates one of the darts 63 on the inner ring that is partially extended outward from a front opening 169 to illustrate a manner in which such a dart 63 may be launched.

Figure 4:
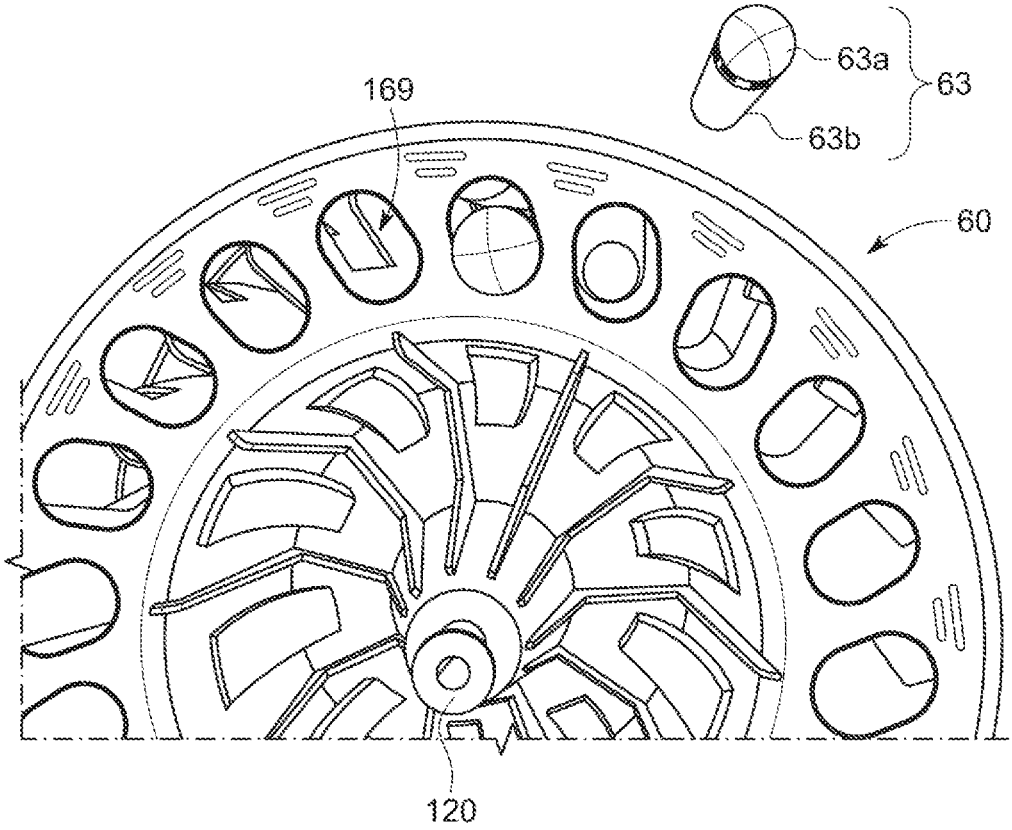
FIG. 4 is a partial front view of the drum shown in FIG. 3 to illustrate respective dimensions of darts and front openings according to an exemplary embodiment of the present invention.

FIG. 4 is a partial front view of the drum 60 shown in FIG. 3 to illustrate respective dimensions of darts 63 and front openings 169 according to an exemplary embodiment of the present invention. As shown in FIG. 4, front openings 169 are dimensioned slightly smaller across one dimension (12.7 mm) than dart 63 and dart cap 63*a* (13 mm), and are dimensioned slightly larger than dart 63 and dart cap 63*a* across another dimension (17.4 mm). As described before, the front openings 169 are so dimensioned to provide for darts 63 on the inner ring of drum 60 not exiting out the front of drum 60 when, say, launcher 1 is tilted or pointed downward. At the same time, the dimensions of these openings (69) still allow push rod 70, with sufficient forward pushing force though back opening 66 (FIGS. 3 and 9C), to squeeze the resilient dart tip 63*a* (and dart body 63*b*) through the front opening (169) during launch. As illustrated in FIG. 4, openings 169 may be oval in shape and may be radially aligned with a slight tilt away from a downward path of a dart 63 from the outer ring into the inner ring by being pushed by member 67 when drum 60 is rotated during launch according to an exemplary embodiment of the present invention. From the front view of FIG. 4, openings 169 are tilted to the left and a downward path of dart 63 would follow a rightward tilt in correspondence with a counterclockwise rotation of drum 60 during launch.

In embodiments, drum 60 may be non-removable from launcher 100. Having a drum 60 as a separable component may be desirable for purposes such as for compact packaging and shipping of launcher 100, or replacing drum 60 as needed or desired (e.g., if broken or for use in launching a different type of projectile, to name a few) or to enable a user to carry a second loaded drum to increase the user's firepower.

In alternative embodiments, a retractable rod (not shown) may be used in place of openings 210 and 210*b* on the bottom of launcher 100 to allow drum 60 to be loaded into launcher 100—i.e., drum 60 may incorporate a corresponding aperture in place of attachment element 120 shown in FIG. 3 for fitting onto such a retractable rod. Once drum 60 is loaded into launcher 100, the rod may be returned to a closed position to retain drum 60. In embodiments, the rod may be secured in a closed position with a releasable lock or latch so that drum 60 is not accidentally released from launcher 100. The rod may be retracted from the center of drum 60 to allow drum 60 to be removed. In embodiments, a release button (not shown) or the like may be incorporated in launcher 100 to release the lock or latch.

In the illustrated embodiment, drum 60 is configured to shoot toy darts. Darts may be loaded into drum 60 before drum 60 is loaded into launcher 100 and/or darts may be loaded and/or refilled in drum 60 after drum 60 is loaded into the launcher.

Figure 5:
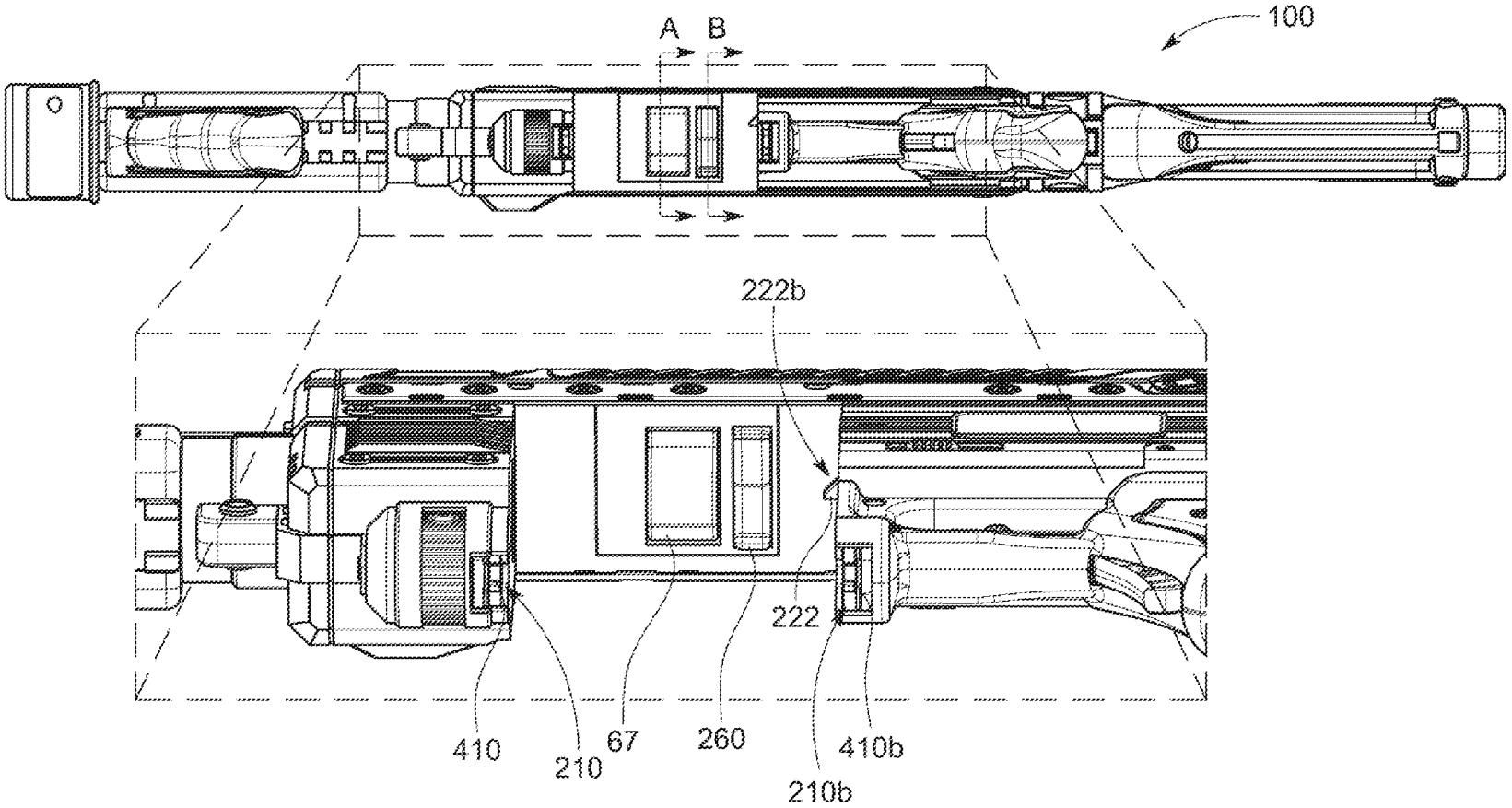
FIG. 5 is a close-up bottom view of the toy dart launcher shown in FIG. 2.

FIG. 5 is a close-up bottom view of toy dart launcher 100. As shown in FIG. 5, launcher 100 includes resilient holders 410 and 410*b* within openings 210 and 210*b*, respectively. Resilient holder 410 includes a fitted hook for fitting around and rotatably retaining attachment element 120 on the front of drum 60 shown in FIG. 3. Correspondingly, resilient holder 410*b* also includes a fitted hook for fitting around a similar retaining attachment element (not shown) on the back of drum 60. FIG. 5 further illustrates the arrangement of push member 67 and notched stopper 260 at the top portion of recess 30 in launcher 100.

Figure 6A:
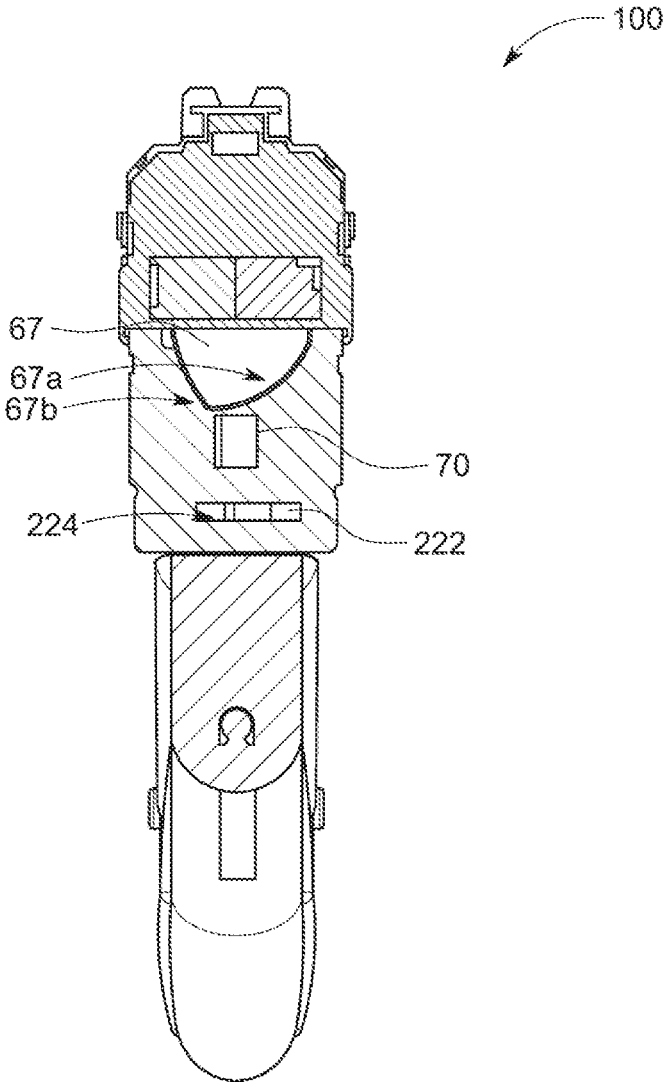
FIG. 6A is a partial front cross-sectional view of the toy dart launcher shown in FIG. 5 illustrating a dart push member according to an exemplary embodiment of the present invention.
Figure 6B:
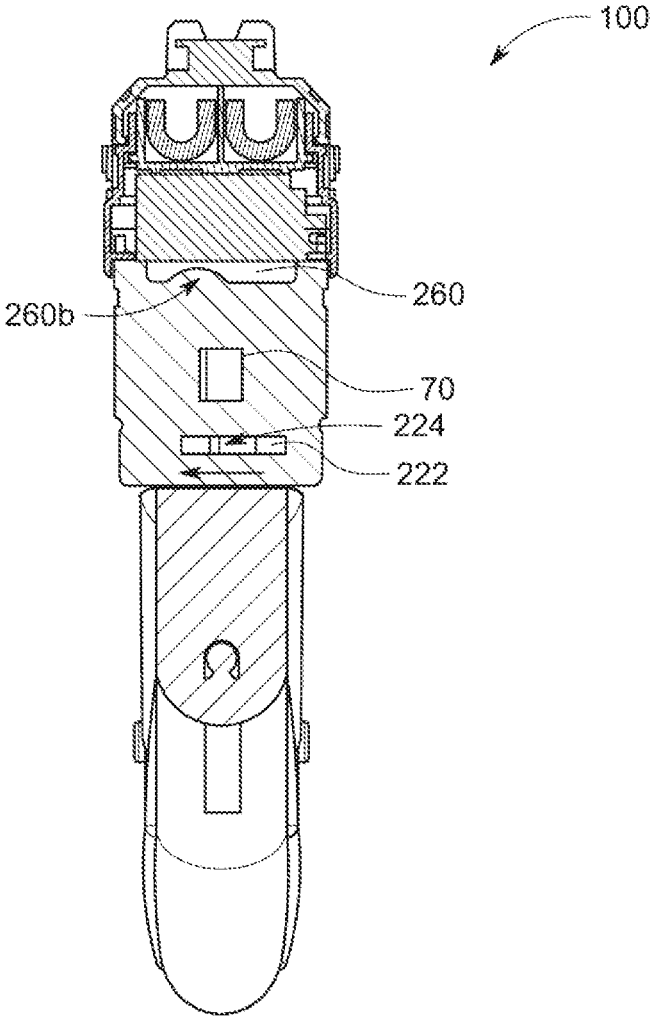
FIG. 6B is a partial front cross-sectional view of the toy dart launcher shown in FIG. 5 illustrating a drum stop member according to an exemplary embodiment of the present invention.

FIG. 6A is a partial front cross-sectional view of launcher 100 along line A indicated in FIG. 5, and FIG. 6B is a partial front cross-sectional view of launcher 100 along line B indicated in FIG. 5. As shown in FIG. 6A, spring-loaded push member 67 includes a push surface 67*a* and a release surface 67*b*. According to an exemplary embodiment, push member 67 is internally mounted to launcher 100 around a pivot mount (not shown) at an upper end of release surface 67*b*. As shown in FIGS. 6A and 6B, pusher (hook element) 222 is movable along a track 224. According to an exemplary embodiment, hook element 222 is coupled to, for example, front handle 52 shown in FIG. 1 via an internal drum advancement mechanism (not shown) such that a back and forth, cocking motion by a user on handle 52—in a manner similar to a pump-action shotgun—would compel hook element 222 to move from the right hand position shown in FIGS. 6A and 6B towards a left portion of track 224 (see arrow in FIG. 6B) and back. Correspondingly, drum 60 incorporates a ring of ridges and notches (not shown) on the back surface thereof that are positioned to engage hook element 222 so that the aforementioned movement would cause drum 60 to rotate by an angle corresponding to the distance travelled by hook element 222 along track 224.

FIG. 6B also illustrates a notch 260*b* in stopper 260. According to an exemplary embodiment, notch 260*b* is dimensioned to fit approximately around a support portion 61*b* on drum 60, as shown in FIG. 3. Additionally, stopper 260 is biased downward—by a spring and the like—so that it is retractable by an upward force from the support portion 61*b* during rotation of drum 60 but would hold drum 60 in place around the support portion 61*b* when notch 260*b* is aligned therewith.

As shown in FIG. 5, hook element 222 incorporates an inclined trailing surface 222*b*. According to an exemplary embodiment, hook element 222 is biased outward from back wall 32 of launcher 100 by a spring (not shown) so that hook element 222 is retractable inward into back wall 32 when an inward force is exerted thereon. Accordingly, when hook element 222 is moved from the original position shown in FIG. 6B leftward—by, say, a backward pull on handle 52—the leading flat surface of hook element 222 engages a ridge (not shown) on the back surface of drum 60 and pushes drum 60 to rotate in the counterclockwise direction according to the orientation shown in FIG. 6B. When hook element 222 is returned from the leftward position back toward the original position shown in FIG. 6B—by, say, a forward return of handle 52—the inclined trailing surface 222*b* slides along a next ridge (not shown) on the back surface of drum 60, pushing hook element 222 inward into back wall 32 until hook element 222 clears the next ridge, whereby the internal biasing spring (not shown) pushes hook element 222 back outward from back wall 32 for engaging the next ridge in a next incremental rotation of drum 60.

As illustrated in FIG. 6A, push surface 67*a* is angled upwardly in relation to release surface 67*b*, which extends from an internal pivot mount. The pivot mount forms a spring-loaded hinge against launcher 100, where a spring (not shown) exerts a downward bias on member 67. According to an exemplary embodiment of the present invention, drum 60 is rotated in a counterclockwise direction per the front views shown in FIGS. 6A and 6B (by hook element 222 pushing leftward), after a dart 63 is launched and drum 60 is advanced to a next dart 63—either by a pump action on handle 52 as described above or by an automatic firing/advancing mechanism. Drum 60 shown in FIGS. 3 and 4 is advanced one slot where a next outer support portion 61*b* is rotated to a position that aligns approximately with notch

260*b* on stopper 260. In the meantime, a next dart 63 on the outer ring is pushed down to the inner ring by push member 67 for launch—either by another trigger pull (semi-automatic) or by continuous trigger pull (automatic). In embodiments, projectile holder 61 within each of the inner and outer concentric rings are of substantially equal dimensions, are substantially-equally spaced apart from one another, and are spaced apart as little as possible to fit as many darts as possible in the drum at a time. In the illustrated embodiment, for example, there are twenty (20) projectile holders, although drum 60 may be alternatively configured to hold more or fewer darts.

The arrangement of projectile holders 61 that hold darts 63 in two (2) concentric rings, along with the use of spring-loaded push member 67 to push the darts 63 on the outer concentric ring into the emptied inner concentric ring, allows for a simplified launcher construction to move a single pushing rod 70 to launch a projectile. Accordingly, push surface 67*a* exerts a downward force against a dart 63 on the outer concentric ring of darts 63 held in projectile holders 61 around drum 60.

According to an exemplary embodiment, the presence of a dart 63 on the inner ring shown in FIG. 3 would prevent a corresponding dart 63 on the outer ring in the same aligned holder 61 from being pushed in by push surface 67*a* of spring-loaded push member 67. Referring back to FIG. 6A, push surface 67*a* is a curved surface so that a portion leading an apex of the curve (rightward portion in FIG. 6A) would exert more force on a dart 63 than the portion trailing the apex of the curve. Consequently, push member 67, being spring loaded around a pivot connected to the release surface 67*b*, would be pushed upward by the dart 63 on the outer ring—if it is obstructed by another dart 63 in the same holder 61 on the inner ring of drum 60—until it is cleared toward the release surface 67*b* as drum 60 is advanced, in the counterclockwise direction in FIGS. 6A and 6B. In contrast, when an inner ring position of holder 61 corresponding to a dart 63 on the outer ring is empty, the leading portion of push surface 67*a* would exert sufficient force to push the dart 63 inward and downward into the empty inner ring position of the holder 61—and, correspondingly, a next firing position.

Figure 7:
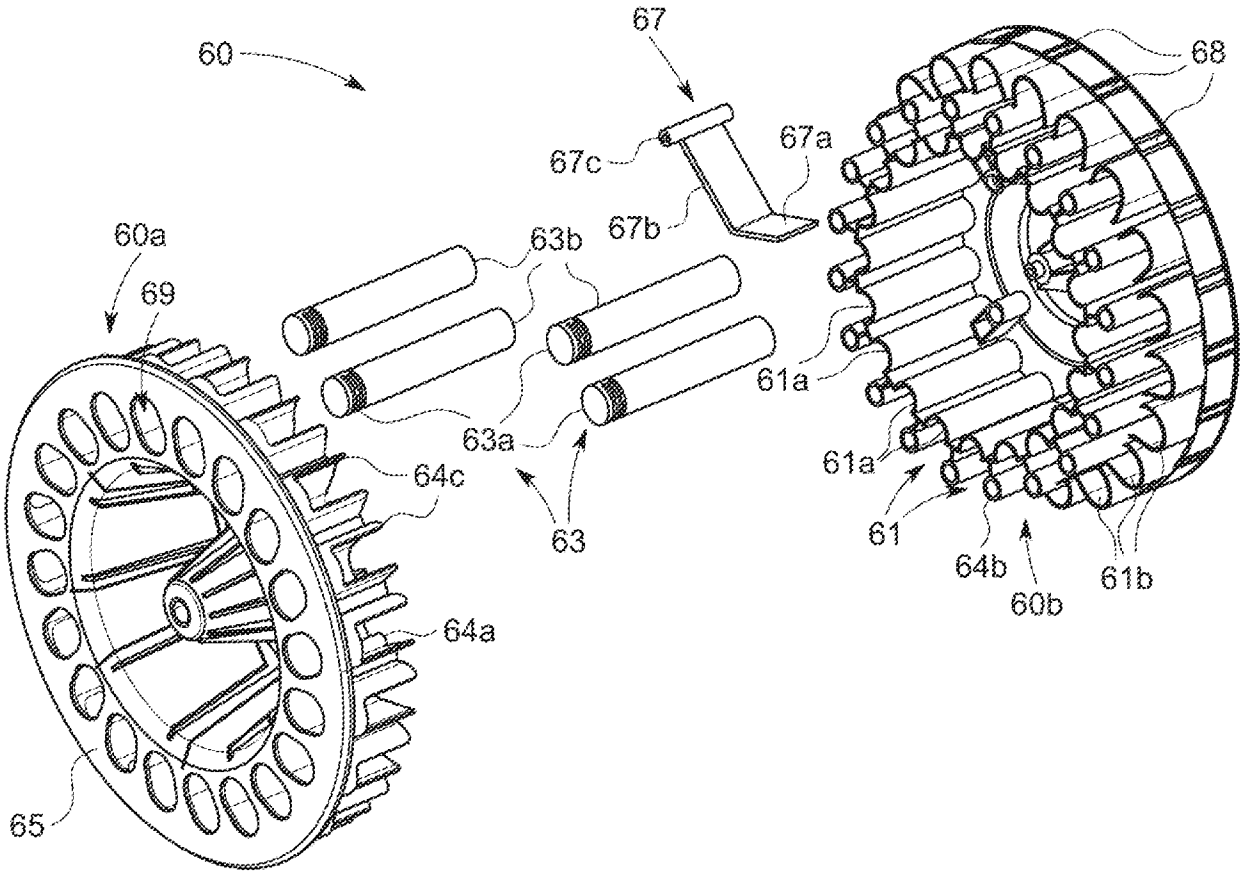
FIG. 7 is an exploded view of a drum for the toy launcher according to another exemplary embodiment of the present invention.

FIG. 7 depicts an exploded view of another exemplary embodiment of drum 60 for use in launcher 100. Drum 60 may include two (2)—front 60*a* and back 60*b*—portions that are assembled together. As shown in FIG. 7, a ring of projectile holders (or chambers) 61 spaced around the periphery of back portion 60*b* of drum 60. In accordance with an exemplary embodiment of the invention, the ring of projectile holders 61 on back portion 60*b* of drum 60 is formed by an inner ring of support portions 61*a* and an outer ring of support portions 61*b*. As illustrated in FIG. 7, the inner ring of support portions 61*a* forms an inner circumferential support structure having respective rounded portions for receiving and holding toy projectiles in respective projectile holders 61. Correspondingly, the outer ring of support portions 61*b* forms an outer circumferential support structure having respective rounded portions for receiving and holding toy projectiles in respective projectile holders 61. Accordingly, inner support ring 61*a* and outer support ring 61*b* together form rings of two (2) rounded support portions that are spaced apart and dimensioned to accommodate corresponding two (2) concentric rings of projectiles in an aligned arrangement—in other words, an inner projectile and an outer projectile in an aligned arrangement in each projectile holder 61. Thus, the ring of projectile holders 61 each having the two (2) rounded support portions 61*a* and 61*b* is configured to receive and hold two (2) concentric and aligned rows of toy projectiles around drum 60.

As further illustrated in FIG. 7, the two (2) front and back portions 60*a* and 60*b* of drum 60 are assembled by coupling insertion members 64*a* on front portion 60*a* with receptacles 64*b* on back portion 60*b*. According to an exemplary embodiment of the present invention, receptacles 64*b* are formed between inner rounded support portions 61*a* to form a circular ring in correspondence with the inner ring of rounded support portions 61*a*—and, thereby, also serve to divide the projectile holders 61 for the inner concentric ring of toy darts. As illustrated in FIG. 7, the receptacles 64*b* are cylindrical in shape and extend in the forward direction from the back portion 60*b* parallel to the firing/storage direction of toy darts 63. Correspondingly, insertion members 64*a* on the front portion 60*a* are also cylindrical in shape and aligned with receptacles 64*b* to form a corresponding ring around front portion 60*a*. Insertion members 64*a* are dimensioned to be smaller than receptacles 64*b* for insertion therein. Accordingly, drum 60 may be assembled by inserting the ring of insertion members 64*a* on front portion 60*a* into the corresponding ring of receptacles 64*b* on the back portion 60*b*. One or more fastening elements (not shown) are further incorporated to hold the front and back portions 60*a* and 60*b* together. Such fastening elements may be detachable for easy disassembly of drum 60. For example, the inner ring of toy darts 63 may be more conveniently loaded with the drum 60 disassembled. According to such an exemplary embodiment of the present invention, the inner ring of toy darts 63 is inserted proximate the respective inner rounded support portions 61*a* between the receptacles 64*b* and, once filled, the drum 60 is assembled. The outer ring of toy darts 63 may also be loaded before or after drum 60 is assembled.

As shown in FIG. 7, front portion 60*a* further incorporates a ring of corresponding pairs of resilient flaps 64*c* that are aligned with insertion members 64*a* (and receptacles 64*b* when drum 60 is assembled) for separating toy darts 63 on the outer ring of drum 60. At locations corresponding to insertion elements 64*a*, the pairs of flaps 64*c* are slanted to form V shapes outward from insertion element 64*a*. Consequently, as illustrated in FIG. 7, the resilient flaps 64*c* are slanted against one another in a manner corresponding to trapezoidal legs that support the two sides of an outer toy dart 63 against outer support portion 61*b*. Operationally, the resilient flaps 64*c* slant inward to support the outer toy dart 63 where a diameter of the toy darts 63 is slightly larger than a distance between the flaps 64*c* at the points at which the toy darts 63 are supported. According to an exemplary embodiment of the present invention, resilient flaps 64*c* may be formed with a resilient material and dimensioned to provide sufficient mechanical strength to support the weight of a toy dart 63 but would also provide sufficient flexibility and resilience to allow a supported toy dart 63 to be pushed inward between the flaps 64*c* towards the inner ring of toy darts 63 supported by inner support portions 61*a*, as described in further detail below.

Figure 8:
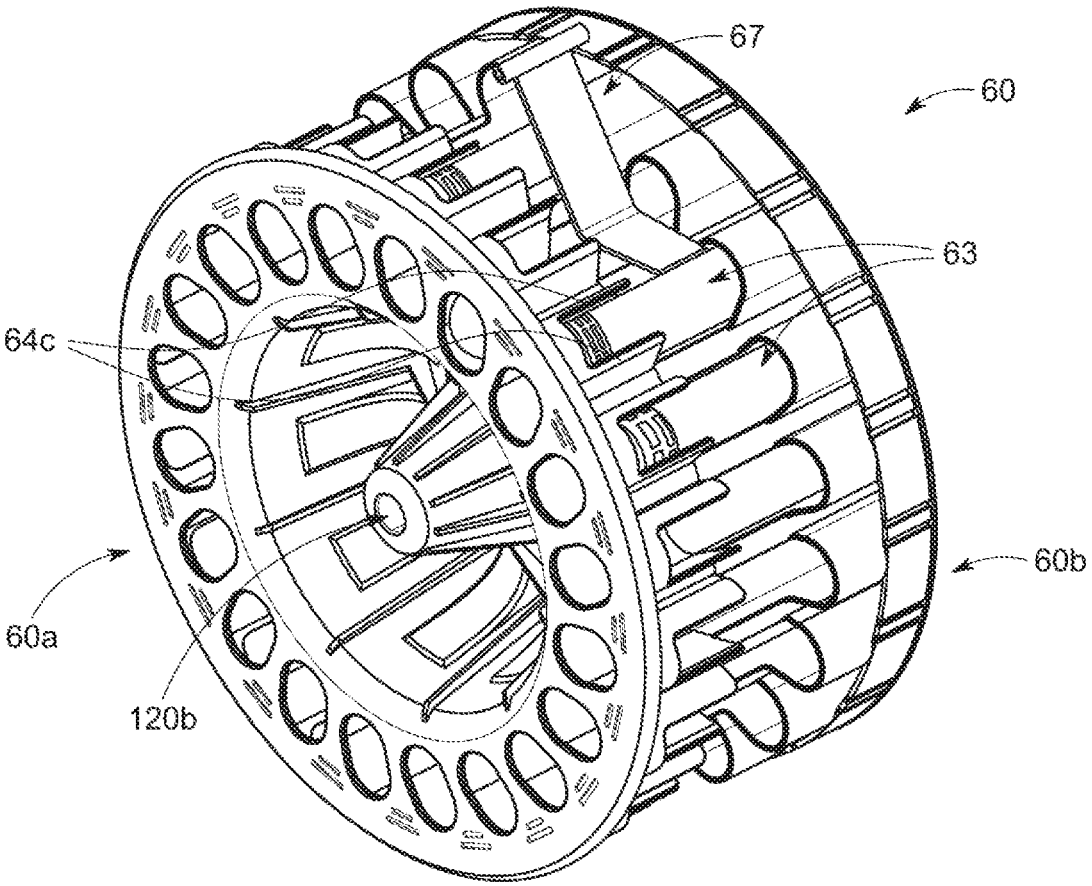
FIG. 8 is a perspective view of the drum shown in FIG. 7 in assembled form.

As shown in FIG. 7, each dart 63 has a cap 63*a* that is affixed to an elongate dart body 63*b*, where the cap 63*a* has a configuration that enables the dart to relatively accurately target a person or object and travel a relatively long distance, while impacting the target in a safe manner. Darts are loaded into projectile holders 61 via the front side of the back portion 60*b* of drum 60 after assembly, as shown in FIG. 8. As shown in FIGS. 7 and 8, the toy darts 63 may be loaded into the inner concentric ring—i.e., onto inner rounded portions 61*a*—before assembling drum 60 or by sliding under flaps 64*c* and bending/straightening the darts 63 into back portion 60*b* when drum 60 is assembled. The toy darts 63 may be loaded into the outer concentric ring—i.e., at outer support portions 61*b*—by sliding the dart bodies 63*b* under outer support portions 61*b* in back portion 60*b* and placing the caps 63*a* between adjacent slanted flaps 64*c*, as illustrated in FIG. 8.

When loaded, each dart 63 is fully within a corresponding projectile holder 61 in that a front wall 65 on the front portion 60*a* of drum 60 is positioned to hold and align the darts 63 that are held on an outer ring around drum 60. Correspondingly, as shown in FIGS. 7 and 8, front wall 65 includes a ring of front openings (e.g., 69) for allowing darts 63 to be pushed forward for launch.

FIG. 8 is a perspective view of an assemble drum 60 with the four darts 63 shown in FIG. 7 loaded therein to illustrate operation of spring-loaded push member 67. Darts 63 may be loaded before drum 60 is loaded into launcher 1 or may be loaded and reloaded after drum is inserted into launcher 1. As shown in FIGS. 7 and 8, inner support ring 61*a* extends forward from back portion 60*b* of drum 60 to meet front portion 60*a* so that an inner ring of projectiles (darts) 63 is fully supported. As further illustrated in FIG. 7, inner support ring 61*a* includes a ring of fitting holes 64*b* in which corresponding rods 64*a* on front portion 60*a* are inserted for an aligned assembly of drum 60. As will be described in further detail below, once drum 60 is assembled, outer support ring 61*b* on back portion 60*b* is receded from inner support ring 61*a* so that an opening is provided for a spring-loaded push member 67 to exert a force on darts 63 on an outer concentric ring in holders 61 towards the inner concentric ring. According to an exemplary embodiment of the invention, spring-loaded push member 67 includes a push surface 67*a*, a release surface 67*b*, and a pivot mount 67*c*. As illustrated in FIG. 7, push surface 67*a* is angled upwardly in relation to release surface 67*b*, which extends from pivot mount 67*c*. Pivot mount 67*c* forms a spring-loaded hinge against launcher 1 at a pivot point (not shown) on launcher 100.

Figure 9A:
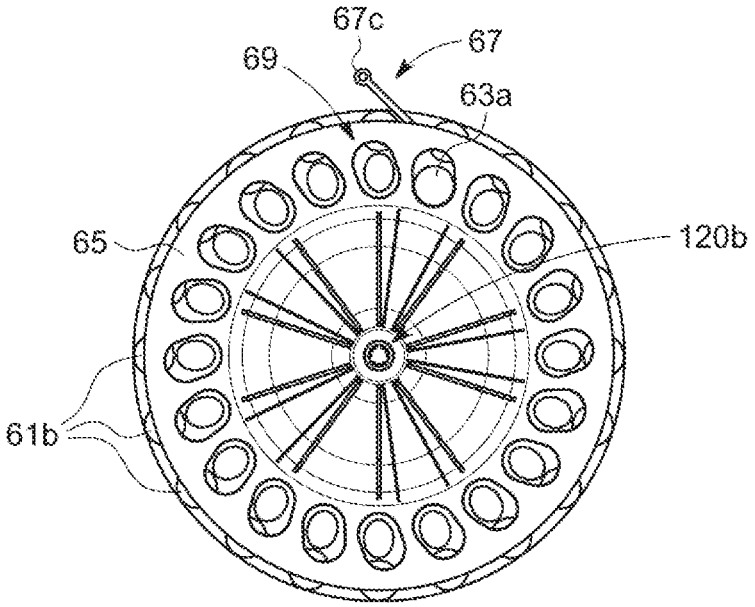
FIG. 9A is a front view of the drum of FIG. 8 in accordance with an embodiment of the present invention.
Figure 9B:
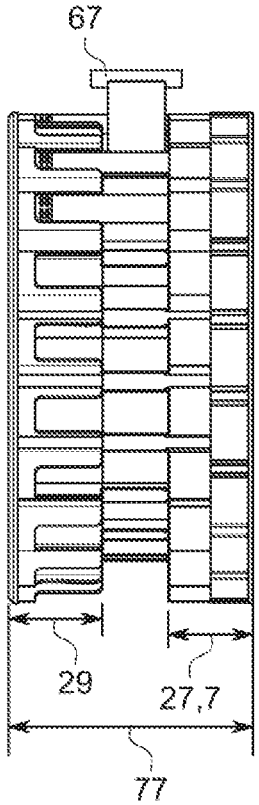
FIG. 9B is a side view of the drum of FIG. 8 in accordance with an embodiment of the present invention.
Figure 9C:
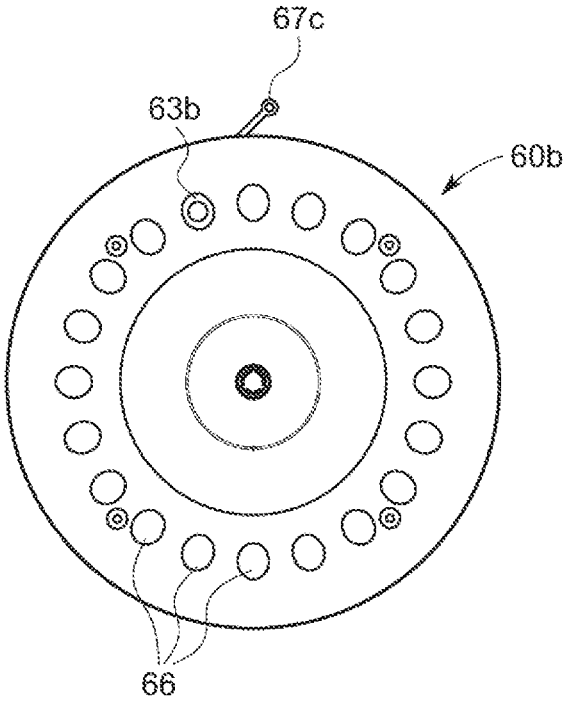
FIG. 9C is a back view of the drum of FIG. 8 in accordance with an embodiment of the present invention.

FIG. 9A is a front view, FIG. 9B is a side view, and FIG. 9C is a back view of an assembled drum 60 corresponding to the perspective view of FIG. 8 with the four darts 63 shown in FIG. 7 loaded therein to illustrate the operation of spring-loaded push member 67. As shown in FIGS. 9A-9C, darts 63 are loaded in projectile holders 61 of drum 60 in aligned concentric rings defined by the respective inner and outer rings of rounded support portions 61*a* and 61*b*. A first of the concentric rings is located substantially at a first radius from the center of drum 60 and a second of the concentric rings is located substantially at a second radius from the center of the drum, where the second radius is different from the first radius. The rounded support portions 61*a* and 61*b* of projectile holders 61 on back portion 60*b* of drum 60 are, thus, spaced in an aligned arrangement such that the darts 63 held in a first concentric ring are aligned in an angular direction with the darts 63 held in a second concentric ring.

FIGS. 9A-9C illustrate one (1) dart 63 being held on an inner (first) concentric ring and three (3) darts 63 being held on an outer (second) concentric ring in respective projectile holders around drum 60. FIGS. 9A-9C illustrate the four (4) toy darts in a configuration where the inner concentric ring of toy darts has been emptied (from firing) and a first dart on the outer concentric ring is pushed down into the inner ring for firing, as illustrated by reference numeral 63*a* on the dart cap of the dart 63 that is aligned with the opening on front wall 65 on the front portion 60*a* of drum 60 in FIG. 9A. According to an exemplary embodiment of the present invention, drum 60 is rotated in a counterclockwise direction per the front and perspective views shown in FIGS. 8 and 9A and in a clockwise direction per the back view shown in FIG. 9C when a dart 63 is launched and drum 60 is advanced to a next dart 63. Correspondingly, as illustrated in FIG. 9C, the dart body 63*b* of the first dart 63 that is pushed by member 67 is aligned with an opening 66 on the back portion 60*b* of drum 60 such that pushing rod 70 can be moved forward in order to push the dart 63 forward to flywheels (not shown) for firing. According to an exemplary embodiment of the present invention, drum 60 shown in FIG. 9C is advanced one slot where 63*b* is rotated to a position that aligns approximately with pivot mount 67*c* (and a corresponding pivot point on launcher 100) and is pushed forward (via opening 66 by push rod 70 shown in FIG. 2) through a front opening on front wall 65 corresponding to location 69 shown in FIG. 9A. In the meantime, a next dart 63 on the outer ring is pushed down to the inner ring by push member 67 for launch—either by another trigger pull (semi-automatic) or by continuous trigger pull (automatic). In embodiments, projectile holder 61 within each of the inner and outer concentric rings are of substantially equal dimensions, are substantially-equally spaced apart from one another, and are spaced apart as little as possible to fit as many darts as possible in the drum at a time. In the illustrated embodiment, for example, there are twenty (20) projectile holders, although drum 60 may be alternatively configured to hold more or fewer darts. A center hole 120*b* allows for a retractable rod (not shown) or the like to pass therethrough and retain drum 60 in launcher 100. As described above, drum 60 may incorporate a knob 120 for fitting into holder 410 in opening 210 on the front and a corresponding knob (not shown) for fitting into holder 410*b* in opening 210*b* on the back.

The arrangement of projectile holders 61 that hold darts 63 in two (2) concentric rings, along with the use of spring-loaded push member 67 to push the darts 63 on the outer concentric ring into the emptied inner concentric ring, allows for a simplified launcher construction to move a single pushing rod 70 to launch a projectile. Accordingly, push surface 67*a* exerts a downward force against a dart 63 on the outer concentric ring of darts 63 held in projectile holders 61 around drum 60. FIGS. 9A-9C illustrate the situation where a dart 63 on the outer ring has been pushed down into an empty inner ring. According to an exemplary embodiment of the present invention, the presence of the dart 63 on the inner ring shown in FIGS. 9A-9C would have prevented a corresponding dart 63 on the outer ring in the same aligned holder 61 from being pushed in by push surface 67*a* of spring-loaded push member 67. Consequently, push member 67, being spring loaded, would have been pushed upward by the dart 63 on the outer ring until it is cleared toward the release surface 67*b* as drum 60 is advanced, in the counterclockwise direction in FIG. 9A (or in the clockwise direction in FIG. 9C).

FIG. 9C illustrates a view of a back side of drum 60. As shown in FIG. 9C, the back of drum 60 includes a respective opening 66 for each projectile holder 61 positioned to correspond with an inner concentric ring of the darts 63 held in drum 60. Each opening 66 is sized to be smaller than an outer diameter of elongate dart body 63*b* to prevent a dart 63 held in the respective projectile holder 61 from exiting out of the back of drum 60. At the same time, opening 66 is sized to enable a pushing rod, described below, with a diameter smaller than opening 66 to pass through opening 66 and push a dart loaded in drum 60 out through the front opening 69 on front wall 65. Corresponding to the above, the front openings (including 69) on front wall 65 are sized slightly smaller than front tip 63*a* of dart 63 (e.g., 1 mm smaller in diameter or width) across one dimension (e.g., circumferential direction around drum 60) and slightly larger across another dimension (e.g., radial direction outward from drum 60) so that darts 63 on the inner ring of drum 60 do not exit out the front of drum 60 when, say, launcher 1 is tilted or pointed downward. At the same time, the dimensions of these openings (69) still allow push rod 70, with sufficient forward pushing force though back opening 66 (FIG. 9C), to squeeze the resilient dart tip 63*a* (and dart body 63*b*) through the front opening (69) during launch. According to an exemplary embodiment of the present invention, openings (69) may be oval in shape and may be radially aligned, as illustrated in FIG. 9A. As described below, openings may also be tilted in relation to the radial direction of drum 60 according to an exemplary embodiment of the present invention.

Figure 10:
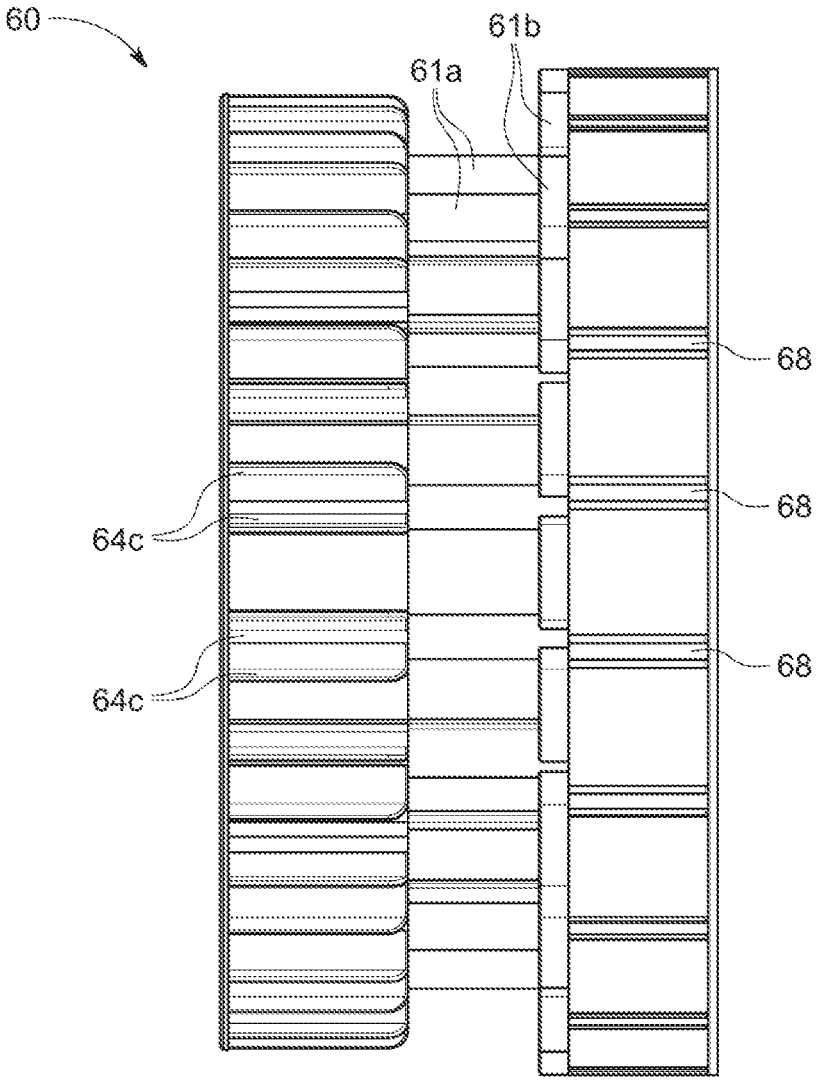
FIG. 10 is a side view of the drum of FIG. 8 without toy darts loaded therein in accordance with an embodiment of the present invention

FIG. 10 depicts a side view of drum 60 of FIGS. 7-9C without darts in accordance with an embodiment of the present invention. In the illustrated embodiment, outer concentric substantially cylindrical support portions 61*b* of projectile holders 61 of drum 60 are connected to each other by elongated ribs 68 that may extend, for example, between a range of approximately one quarter of the width of drum 60 starting at the back side of drum 60 to strengthen drum 60. In embodiments, outer support portions 61*b* extend forward beyond elongated ribs 68 of the drum 60 so that, in embodiments, spring-loaded catch (stopper) 260 shown in FIGS. 2, 5, and 6B may be adapted to press against an outer surface at outer support portions 61*b* or ribs 68 to limit rotational movement of drum 60 when a projectile is launched. As drum 60 is incrementally rotated, the catch 260 is released from outer support portions 61*b* or ribs 68 to allow drum 60 to rotate before the next projectile holder 61 is aligned for launch. Again, flaps 64*c* are disposed near the front of drum 60 to divide adjacent darts 63 on an outer concentric ring and for providing minimal support for these darts 63 away from an aligned inner concentric ring of darts 63 stored in drum 60 so that the outer darts do not hinder, via friction or otherwise, the inner darts during launch. Push member 67 disposed between outer support portions 61*b* and flaps 64*c* can, thus, contact and exert downward force on darts 63 on the outer ring in drum 60.

Figure 11:
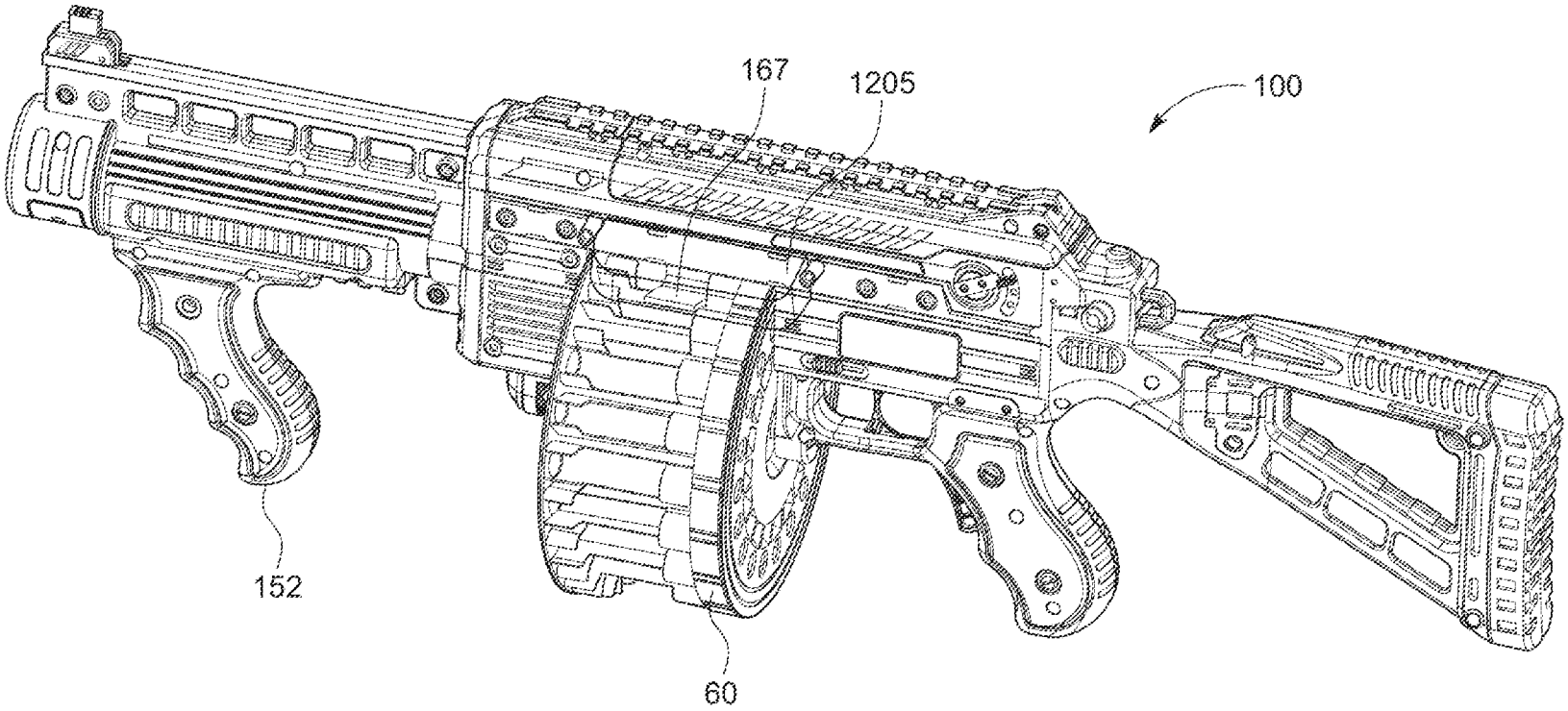
FIG. 11 is a perspective view of a launcher with drum illustrating an improved exemplary embodiment of the present invention.

FIG. 11 is a perspective view of a launcher 100 with drum 60 illustrating another exemplary embodiment of the present invention. As illustrated in FIG. 11 and in contrast from FIGS. 2, 5, 6A, and 7-9C, push member 167 may be anchored to launcher 100 at an extension portion 1205. Extension portion 1205 is shown in FIG. 11 with semi-transparency in order to illustrate the arrangement of push member 167 and may be made with an opaque material.

Figure 12:
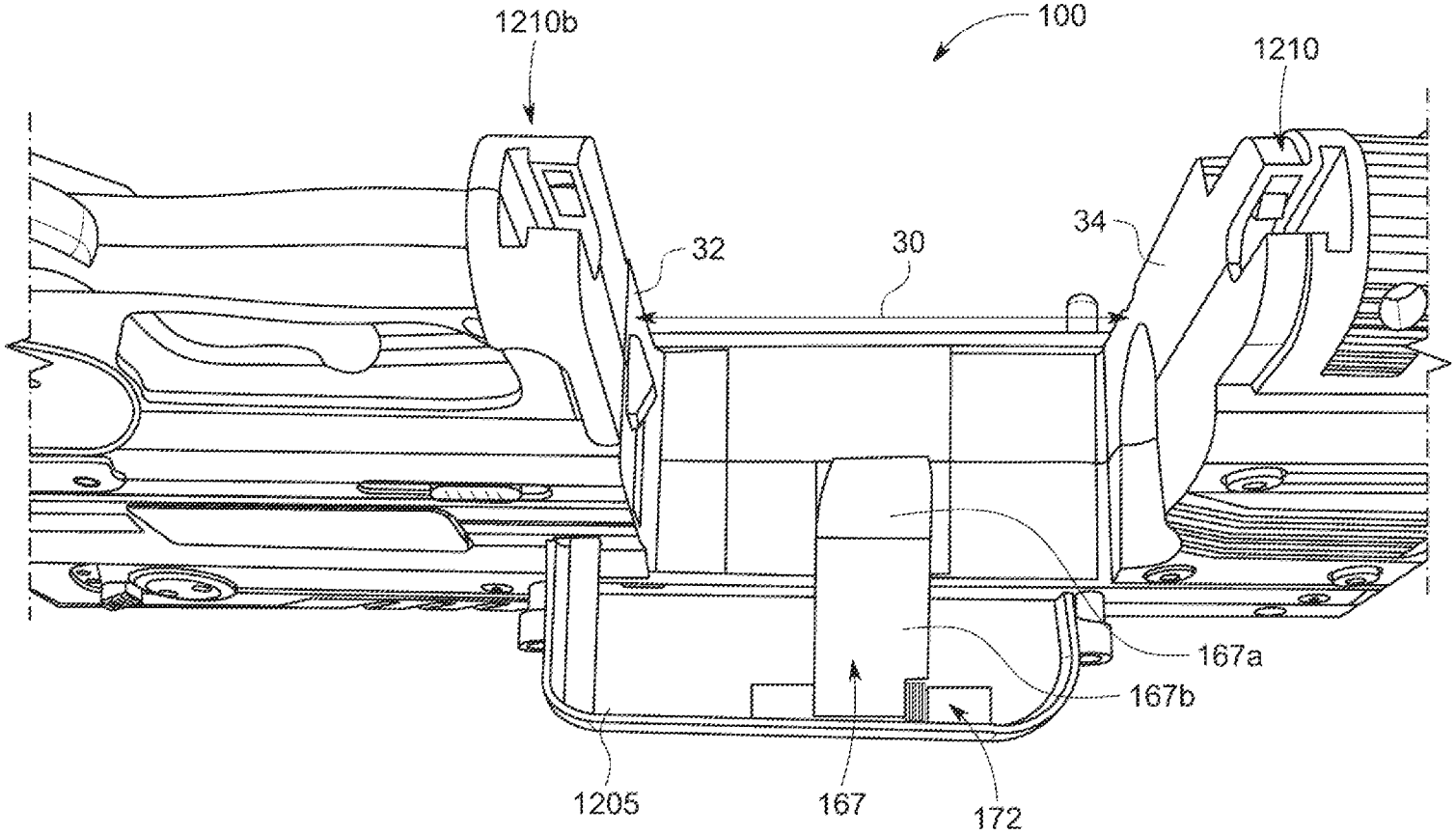
FIG. 12 is a bottom view showing a designated space or recess 30 of the launcher 100 shown in FIG. 11 according to an exemplary embodiment of the present invention.

FIG. 12 is a bottom view showing a designated space or recess 30 of the launcher 100 shown in FIG. 11 according to an exemplary embodiment of the present invention. As shown in FIG. 12, spring-loaded push member 167 is attached and anchored to extension portion 1205 at pivot point 172. Push member 167 is anchored on an opposite side in relation to a pushed dart 63 than the manner in which push member 67 shown in FIGS. 7-9C is arranged. In other words, while both push members 67 and 167 have two angled surfaces (e.g. 67*a* and 67*b*, and 167*a* and 167*b*), push member 67 contacts and pushes an outer ring dart 63 on the surface (67*a*) away from the anchor point (67*c*), and push member 167 contacts and pushes an outer ring dart 63 on the surface (167*b*) proximate the anchor point at pivot point 172. This distinction may be attributable to flaps 64*c* holding up the outer ring darts 63 shown in FIGS. 7-9C requiring slightly larger downward force than outer ring darts 63 shown in FIG. 3, which are held up on the outer ring solely by inner ring darts 63. In other words, the outer ring darts 63 shown in FIG. 3 may drop downward into the inner ring via gravity when a corresponding inner ring dart 63 has been launched and the dart holder 61 is near vertical at a firing position. Push member 167 provides additional downward force to ensure that such a dart 63 would be not held up on the outer ring by friction, misalignment, or the like. As shown in FIG. 12, launcher 100 includes opening 1210 on a bottom portion of front wall 34 of recess 30 for receiving knob 120 of drum 60 illustrated in FIGS. 3 and 4. Correspondingly, a similar opening 1210*b* may be incorporated on a bottom portion of back wall 32 of recess 30 for receiving a corresponding knob (not shown) on a back portion of drum 60.

The configuration shown in the figures and described above reduces the materials needed to construct drum 60 and, therefore, further improves upon the material costs and operation of launcher 100. For example, with drum 60 being substantially lighter, in the semi-automatic mode—where each pull of the trigger 20 would rotate the drum—the physical effort would be reduced—due to a lighter mass. Correspondingly, the energy required for launch in the automatic mode would also be reduced—thus extending battery life for launcher 100.

While particular embodiments of the present invention have been shown and described in detail, it would be obvious to those skilled in the art that various modifications and improvements thereon may be made without departing from the spirit and scope of the invention. It is therefore intended to cover in the appended claims all such modifications and improvements that are within the scope of this invention.

What is claimed is:

1. A toy launcher for launching projectiles, comprising:

(a) a drum having a substantially circular shape and comprising a ring of projectile holders to hold projectiles for launching, the ring of projectile holders comprising:

(1) a ring of inner support portions located substantially at a first radius from a center of the drum, each inner support portion adapted to support at least a portion of a projectile on an inner concentric ring of projectiles, and (2) a ring of outer support portions located substantially at a second radius from the center of the drum, each outer support portion adapted to support at least a portion of a projectile on an outer concentric ring of projectiles, wherein the second radius is different than the first radius, wherein the drum comprises a ring of front openings and a ring of rear openings that are aligned with at least the inner concentric ring of projectiles;

(b) a push rod adapted to extend through one of the rear openings and push a corresponding one of the inner concentric ring of projectiles through a corresponding one of the front openings; and (c) a trigger that, upon activation, engages the push rod to extend through the one rear opening and push the corresponding one projectile through the corresponding one front opening, wherein the inner support portions are angularly aligned with the outer support portions so that a projectile is movable slidingly from the outer concentric ring to the inner concentric ring.

2. The toy launcher of claim 1, further comprising:

(d) one or more flywheels positioned in front of at least the corresponding one of the front openings of the drum, the one or more flywheels being adapted to propel at least one of the projectiles when pushed from the drum toward the one or more flywheels for launching the at least one of the projectiles out of the toy launcher.

3. The toy launcher of claim 2, wherein at least one of the one or more flywheels are motorized and are positioned adjacent the drum so as to engage with the at least one projectile when the at least one projectile is pushed from the drum.

4. The toy launcher of claim 1, further comprising:

(d) a drum advancement mechanism that causes an incremental rotation of the drum.

5. The toy launcher of claim 4, wherein the drum advancement mechanism is one of an automated mechanism and a manual mechanism coupled to a cocking handle.

6. The toy launcher of claim 4, further comprising:

(e) a push member adapted to exert a pushing force on one of the outer concentric ring of projectiles towards the ring of inner support portions.

7. The toy launcher of claim 6, wherein the push member is spring loaded and comprises a push surface and a release surface.

8. The toy launcher of claim 7, wherein the push surface abuts the one of the outer concentric ring of projectiles when the drum advancement mechanism causes the incremental rotation of the drum.

9. The toy launcher of claim 1, wherein the projectiles are toy darts.

10. The toy launcher of claim 1, wherein the projectiles are toy balls.

11. The toy launcher of claim 1, wherein the drum is removable from the toy launcher.

12. The toy launcher of claim 1, wherein the drum is non-removable from the toy launcher.

13. The toy launcher of claim 1, wherein the projectile holders are substantially equally spaced apart from one another.

14. The toy launcher of claim 1, wherein the projectile holders are adapted to hold toy darts.

15. The toy launcher of claim 1, wherein the projectile holders are of substantially equal dimensions.

16. The toy launcher of claim 1, wherein each front opening comprises at least a first dimension smaller than a radius of the projectiles and at least a second dimension larger than the radius of the projectiles.

17. The toy launcher of claim 16, wherein the front openings are tilted so that an outer portion of each front opening is tilted towards a direction of rotation of the drum.

18. A drum for holding projectiles adapted for launch in a toy launcher, comprising:

a ring of inner support portions located substantially at a first radius from a center of the drum, each inner support portion adapted to support at least a portion of a projectile on an inner concentric ring of projectiles;

a ring of outer support portions located substantially at a second radius from the center of the drum, each outer support portion adapted to support at least a portion of a projectile on an outer concentric ring of projectiles, wherein the second radius is different than the first radius, a ring of rear openings that are aligned with at least the inner concentric ring of projectiles; and a ring of front openings, each front opening having at least one dimension smaller than a radius of the projectiles and at least another dimension larger than the radius.

19. The drum of claim 18, wherein, the front openings are tilted so that an outer portion of each front opening is tilted towards a direction of rotation of the drum when the drum is coupled to the toy launcher.

* * * * *